US007496972B2

(12) United States Patent
Kreitz

(10) Patent No.: US 7,496,972 B2
(45) Date of Patent: Mar. 3, 2009

(54) NECK TIE APPARATUS

(76) Inventor: Garett Kreitz, 225 Herbert Ave., Fanwood, NJ (US) 07023

( * ) Notice: Subject to any disclaimer, the term of this patent is extended or adjusted under 35 U.S.C. 154(b) by 136 days.

(21) Appl. No.: 11/563,353

(22) Filed: Nov. 27, 2006

(65) Prior Publication Data

US 2008/0120760 A1 May 29, 2008

(51) Int. Cl.
*A41D 24/04* (2006.01)

(52) U.S. Cl. ..... 2/145

(58) Field of Classification Search ..... 2/144, 2/145, 149; 24/54, 65, 66.1, 66.2
See application file for complete search history.

(56) References Cited

U.S. PATENT DOCUMENTS 7,036,694 B2 * 5/2006 Smalls ..... 223/82
7,065,794 B2 * 6/2006 Anderson ..... 2/144
7,373,696 B2 * 5/2008 Schoening et al. ..... 24/66.1

* cited by examiner

*Primary Examiner*—Tejash Patel
(74) *Attorney, Agent, or Firm*—Jennifer Meredith, Esq; Meredith & Keyhani, PLLC

(57) ABSTRACT

An apparatus for extending a neck tie, the apparatus comprising: a first piece of fabric sewn to a second piece of fabric along the bottom portion of the first piece of fabric and along the bottom portion of the second piece of fabric to form a Y-shape; a first magnet attached to the top back side of the first piece of fabric; a second magnet magnetically mated to the first magnet and attached to the top back side of the second piece of fabric; a third piece of fabric sewn along the Y-shape, wherein the first magnet is interposed between the first piece of fabric and the third piece of fabric and the second magnet is interposed between the second piece of fabric and the third piece of fabric to form a magnetic Y-shape.

5 Claims, 3 Drawing Sheets

NECK TIE APPARATUS

The present invention relates generally to men's neckties and more specifically to an apparatus for extending the length of any standard tie.

Neckties are common place in business attire. However, a favorite necktie may not be the correct size. Because of this, it would be desirable to lengthen that tie. It is nearly impossible the lengthen the front of the necktie without compromising the aesthetic of the tie. However, the back portion may be lengthened and not viewable to the casual observer. One of the problems with sewing a piece of cloth onto the end of the unseen tail of the tie, is that this is not reversible. Also, each tie would have to tailored separately.

Accordingly, the present invention provides an easy to attach and remove necktie extender that can be used on any number of neckties.

SUMMARY OF THE INVENTION

The present invention relates generally to an apparatus for lengthening a necktie.

An apparatus for extending a neck tie, the apparatus comprising: a first piece of fabric sewn to a second piece of fabric along the bottom portion of the first piece of fabric and the second piece of fabric to form a Y-shape; a first magnet attached to the top back side of the first piece of fabric; a second magnet magnetically mated to the first magnet and attached to the top back side of the second piece of fabric; a third piece of fabric sewn along the Y-shape, wherein the first magnet is interposed between the first piece of fabric and the third piece of fabric and the second magnet is interposed between the second piece of fabric and the third piece of fabric to form a magnetic Y-shape.

According to another embodiment, an apparatus for extending a neck tie, the apparatus comprising: a first piece of fabric sewn to a second piece of fabric along the bottom portion of the first piece of fabric and the second piece of fabric to form a Y-shape; a third piece of fabric sewn along the Y-shape; a first attachment means attached to the top left side of the Y-Shape; and a second attachment means attached to the top right side of the Y shape.

These and other features, aspects and advantages of the present invention will become better understood with reference to the following description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
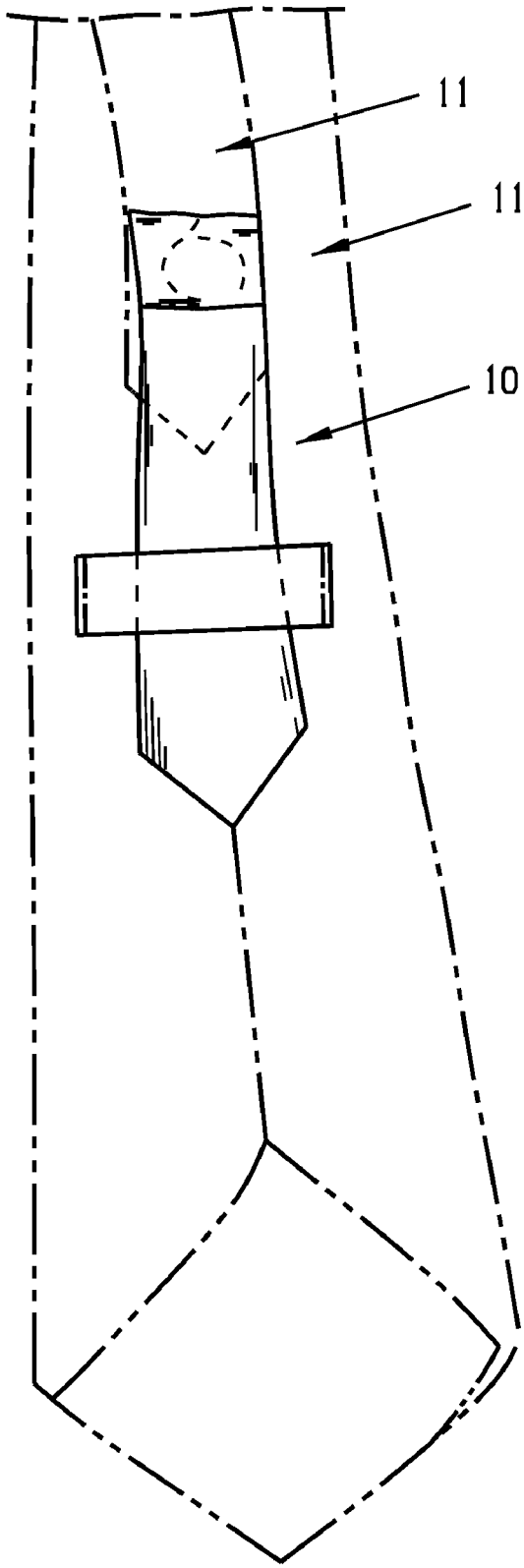
FIG. 1 depicts the present invention.
Figure 2:
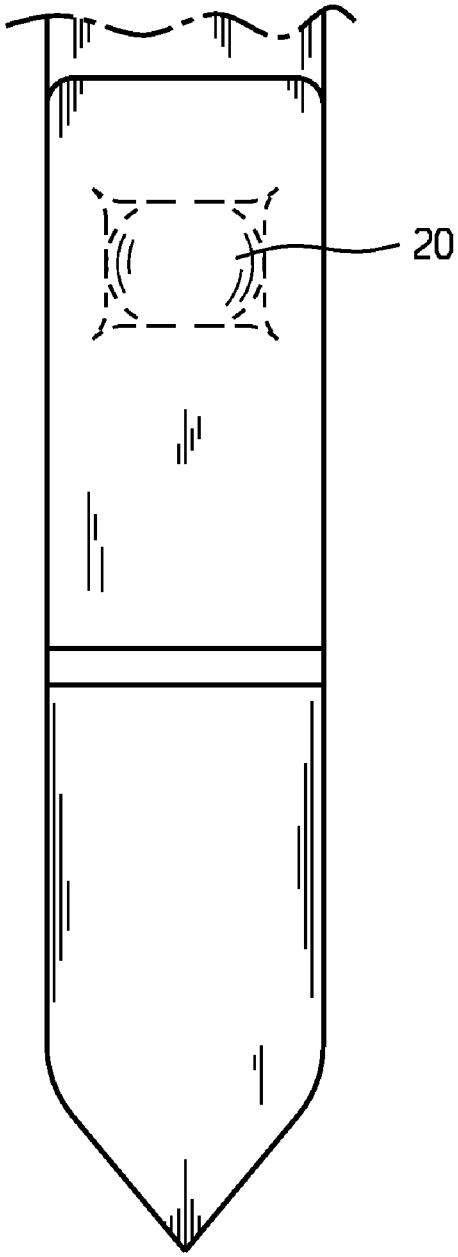
FIG. 2 depicts the present invention.
Figure 3:
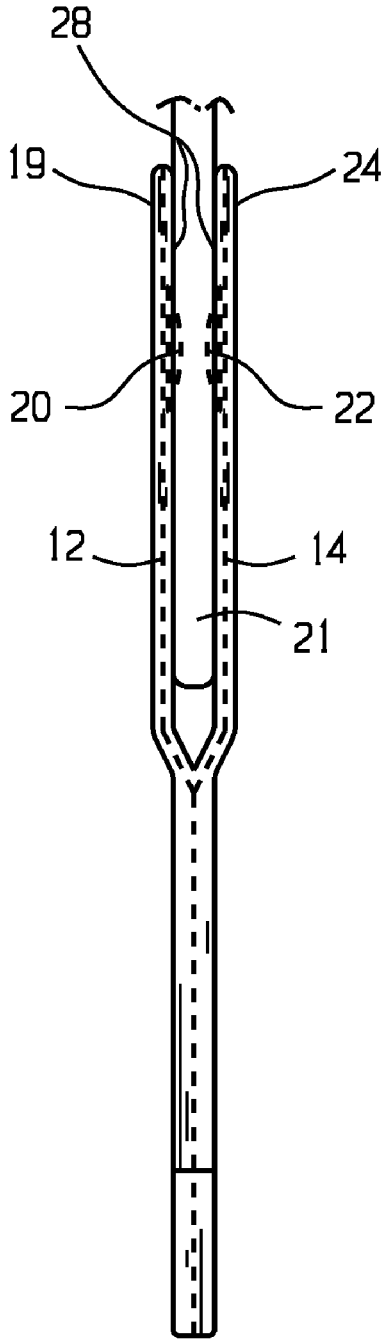
FIG. 3 depicts the present invention.

With reference to FIG. 1, an apparatus (10) for extending a neck tie, the apparatus (10) comprising: a first piece of fabric (12) sewn to a second piece of fabric (14) along the bottom portion (16) of the first piece of fabric (12) and a second piece of fabric (14) to form a Y-shape. A first magnet (20) attached to the top back side (19) of the first piece of fabric (12). The top back side (19) is intended to mean any portion above the Y split. As in the embodiment shown, because the magnet (20) is between two pieces of fabric it is not visible. A second magnet (22) magnetically mated to the first magnet (20) and attached to the top back side (24) of the second piece of fabric (14); a third piece of fabric (28) sewn along the Y-shape, wherein the first magnet (20) is interposed between the first piece of fabric (12) and the third piece of fabric (28) and the second magnet (22) is interposed between the second piece of fabric (14) and the third piece of fabric (28) to form a magnetic Y-shape. The first piece of fabric (12) and second piece of fabric (14) may be tapered (30) and form a tie point at the end. When the first magnet (20) is magnetically attached to the second magnet 22, with the tie (11) between the two, the length of the tie (11) is extended by a desired length.

Figure 4:
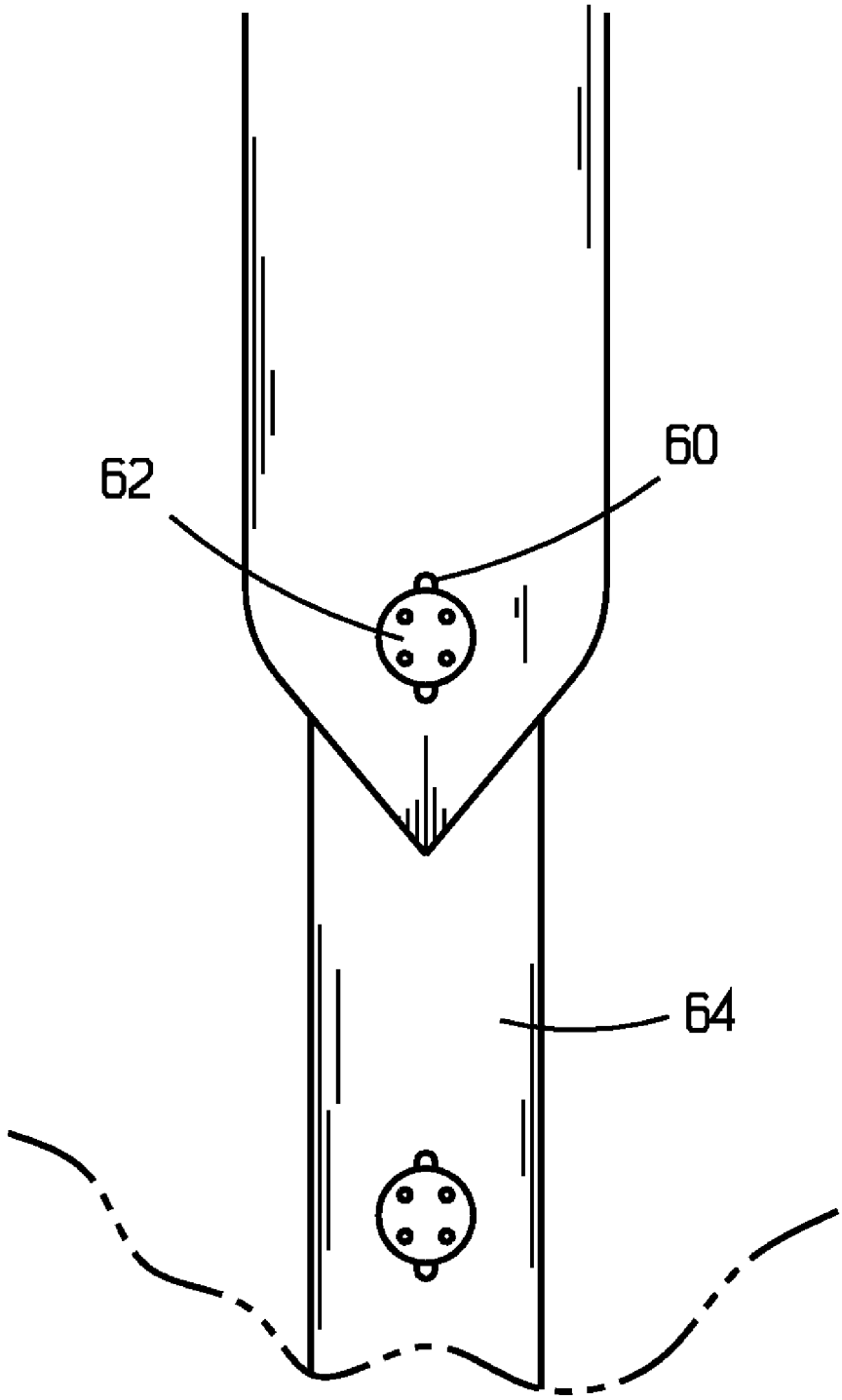
FIG. 4 depicts the present invention.

According to another embodiment, an apparatus for extending a neck tie (11) is disclosed, the apparatus comprising: a first piece of fabric (12) sewn to a second piece of fabric (14) along the bottom portion of the first piece of fabric and the second piece of fabric to form a Y-shape; a third piece of fabric (28) sewn along the Y-shape; a first attachment means (20) attached to the top left side (19) of the Y-Shape; and a second attachment means (22) attached to the top right side (24) of the Y shape. The first attachment means (20) may be selected from the group consisting of hook and eye, snaps, zippers, buttons, hook and loop, interlocking plastic grooves and tape. The second attachment means (22) may be selected from the group consisting of hook and eye, snaps, zippers, buttons, hook and loop, interlocking plastic grooves and tape. There may also be additional attachment means attached to the tie without departing from the present invention. As shown in FIG. 4, there may also, optionally, be a buttonhole (60) for attaching the apparatus (10) to the button (62) of a shirt (64).

It should be understood that the foregoing relates to preferred embodiments of the invention and that modifications may be made without departing from the spirit and scope of the invention as set forth in the following claims.

I claim:

1. An apparatus for extending a neck tie, said apparatus comprising:

a first piece of fabric sewn to a second piece of fabric along the bottom portion of said first piece of fabric and the bottom portion of said second piece of fabric to form a Y-shape;

a first magnet attached to the top back side of said first piece of fabric;

a second magnet magnetically mated to said first magnet and attached to the top back side of said second piece of fabric;

a third piece of fabric sewn along said Y-shape, wherein said first magnet is interposed between said first piece of fabric and said third piece of fabric and said second magnet is interposed between said second piece of fabric and said third piece of fabric to form a magnetic Y-shape.

2. An apparatus as in claim 1, wherein said first piece of fabric is tapered and forms a tie point at the end.

3. An apparatus as in claim 1, wherein said second piece of fabric is tapered and forms a tie point at the end.

4. An apparatus as in claim 1, further comprising a buttonhole at the end of said apparatus.

5. An apparatus for extending a neck tie, said apparatus comprising:

a first piece of fabric sewn to a second piece of fabric along the bottom portion of said first piece of fabric and the bottom portion of said second piece of fabric to form a Y-shape with a tie point at the bottom end and a buttonhole sewn into the bottom portion of said Y-shape;

a first magnet attached to the top back side of said first piece of fabric;

a second magnet magnetically mated to said first magnet and attached to the top back side of said second piece of fabric;

a third piece of fabric sewn along said Y-shape, wherein said first magnet is interposed between said first piece of fabric and said third piece of fabric and said second magnet is interposed between said second piece of fabric and said third piece of fabric to form a magnetic Y-shape.

* * * * *